US010506337B2

(12) United States Patent
Chen et al.

(10) Patent No.: US 10,506,337 B2
(45) Date of Patent: Dec. 10, 2019

(54) FREQUENCY-INVARIANT BEAMFORMER FOR COMPACT MULTI-RINGED CIRCULAR DIFFERENTIAL MICROPHONE ARRAYS

(71) Applicant: Northwestern Polytechnical University, Shanxi (CN)

(72) Inventors: Jingdong Chen, Shanxi (CN); Gongping Huang, Shanxi (CN)

(73) Assignee: Northwestern Polytechnical University, Shanxi (CN)

( * ) Notice: Subject to any disclaimer, the term of this patent is extended or adjusted under 35 U.S.C. 154(b) by 0 days.

(21) Appl. No.: 16/117,186

(22) Filed: Aug. 30, 2018

(65) Prior Publication Data

US 2019/0069086 A1 Feb. 28, 2019

Related U.S. Application Data

(63) Continuation-in-part of application No. PCT/IB2017/001436, filed on Oct. 24, 2017, which is (Continued)

(51) Int. Cl.
*H04R 3/00* (2006.01)
*H04R 1/40* (2006.01)

(52) U.S. Cl.
CPC ..... *H04R 3/005* (2013.01); *H04R 1/406* (2013.01); *H04R 2201/401* (2013.01); *H04R 2430/21* (2013.01)

(58) Field of Classification Search
CPC .. H04R 3/005; H04R 1/406; H04R 2201/401; H04R 2201/405; H04R 2430/23; H04R 2430/20; H04R 5/027; H04R 2410/01; H04R 2201/40; H04R 2420/07; H04R 29/00; H04R 29/005; H04R 1/04; H04S 2400/15; H04S 7/301; G10L 2021/02166
(Continued)

(56) References Cited

U.S. PATENT DOCUMENTS

2011/0194719 A1 8/2011 Frater
2012/0140947 A1 6/2012 Shin
(Continued)

OTHER PUBLICATIONS

Pan, Chao et al. On the Noise Reduction Performance of the MVDR Beamformer in Noisy and Reverberant Environments 2014 IEEE International Conference on Acoustic, Speech and Signal Processing (ICASSP) 31 Dec.2014(31.12.2014), pp. 5.
(Continued)

*Primary Examiner* — Norman Yu
(74) *Attorney, Agent, or Firm* — Zhong Law, LLC

(57) ABSTRACT

A multi-ringed differential microphone array includes a first number of microphones situated along a first substantial circle having a first radius, a second number of microphones situated along a second substantial circle having a second radius, and a processing device, communicatively coupled to the first number microphones and the second number of microphones, to receive a plurality of electronic signals generated by the first number of microphones and the second number of microphones, determine a differential order (N) based on the second number, and execute an N-th order minimum-norm beamformer to calculate an estimate of the sound source based on the plurality of electronic signals.

20 Claims, 5 Drawing Sheets

Related U.S. Application Data a continuation of application No. 15/347,482, filed on Nov. 9, 2016, now Pat. No. 9,930,448.

(58) Field of Classification Search
USPC ..... 381/92, 310, 122, 56, 26, 58; 367/129; 379/202.01
See application file for complete search history.

(56) References Cited

U.S. PATENT DOCUMENTS

| | | | | |
|---|---|---|---|---|
| 2015/0117672 | A1 | 4/2015 | Christoph | |
| 2015/0163577 | A1* | 6/2015 | Benesty ..... | H04R 1/406 381/92 |
| 2015/0281833 | A1* | 10/2015 | Shigenaga ..... | H04R 3/005 381/92 |

OTHER PUBLICATIONS

Pan, Chao et a I Theoretical Analysis of Differential Microphone Array Beamforming and an Improved Solution IEEE/ACM Transactions on Audio, Speech, and Language Processing Nov. 30, 2015(Nov. 30, 2015) No. 11 vol. 23, pp.

International Search Report and Written Opinion dated Apr. 28, 2018 received in PCT/IB17/01436, pp. 8.

* cited by examiner

FREQUENCY-INVARIANT BEAMFORMER FOR COMPACT MULTI-RINGED CIRCULAR DIFFERENTIAL MICROPHONE ARRAYS

CROSS-REFERENCE TO RELATED APPLICATIONS

This application is a continuation-in-part of International Patent Application No. PCT/IB2017/001436 filed Oct. 24, 2017 which claims priority to U.S. patent application Ser. No. 15/347,482 filed Nov. 9, 2016, the contents of which are incorporated by reference in their entirety.

TECHNICAL FIELD

This disclosure relates to microphone arrays and, in particular, to a multi-ringed circular differential microphone array (MR-CDMA) and associated beamformers.

BACKGROUND

Beamformers (or spatial filters) are used in sensor arrays (e.g., microphone arrays) for directional signal transmission or reception. A sensor array can be a linear array where the sensors are arranged approximately along a linear platform (such as a straight line) or a circular array where the sensors are arranged approximately along a circular platform (such as a circular line). Each sensor in the sensor array may capture a version of a signal originating from a source. Each version of the signal may represent the signal captured at a particular incident angle with respect to the corresponding sensor at a particular time. The time may be recorded as a time delay to a reference point such as, for example, a first sensor in the sensor array. The incident angle and the time delay are determined according to the geometry of the array sensor.

BRIEF DESCRIPTION OF THE DRAWINGS

The present disclosure is illustrated by way of example, and not by way of limitation, in the figures of the accompanying drawings.

DETAILED DESCRIPTION

Figure 1:
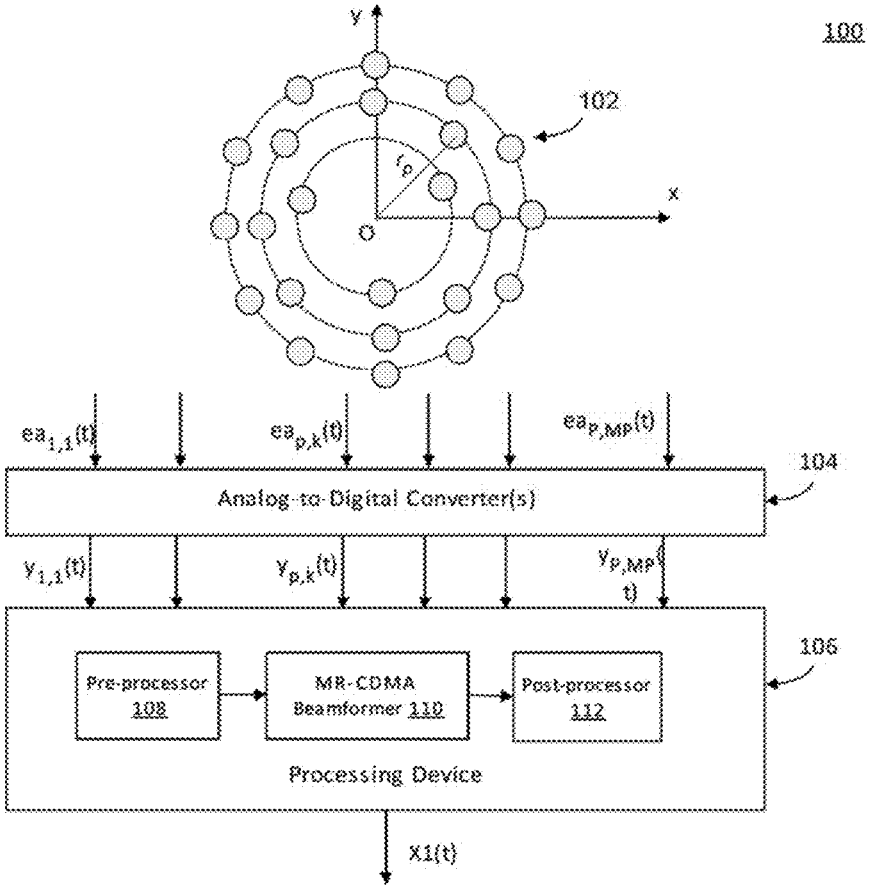
FIG. 1 illustrates a multi-ringed circular differential microphone array (MR-CDMA) system according to an implementation of the present disclosure.

The captured versions of the signal may also include noise components. An array of analog-to-digital converters (ADCs) may convert the captured signals into a digital format (referred to as a digital signal). A processing device may implement a beamformer to calculate certain attributes of the signal source based on the digital signals.

Each sensor in a sensor array may receive a signal emitted from a source at a particular incident angle with a particular time delay to a reference point (e.g., a reference sensor). The sensor can be a suitable type of sensors such as, for example, microphone sensors that capture sound signals. A microphone sensor may include a sensing element (e.g., a membrane) responsive to the acoustic pressure generated by sound waves arriving at the sensing element, and an electronic circuit to convert the acoustic pressures received by the sensing element into electronic currents. The microphone sensor can output electronic signals (or analog signals) to downstream processing devices for further processing. Each microphone sensor in a microphone array may receive a respective version of a sound signal emitted from a sound source at a distance from the microphone array. The microphone array may include a number of microphone sensors to capture the sound signals (e.g., speech signals) and converting the sound signals into electronic signals. The electronic signals may be converted by analog-to-digital converters (ADCs) into digital signals which may be further processed by a processing device (e.g., a digital signal processor (DSP)). Compared with a single microphone, the sound signals received at microphone arrays include redundancy that may be exploited to calculate an estimate of the sound source to achieve certain objectives such as, for example, noise reduction/speech enhancement, sound source separation, de-reverberation, spatial sound recording, and source localization and tracking. The processed digital signals may be packaged for transmission over communication channels or converted back to analog signals using a digital-to-analog converter (DAC).

The microphone array can be communicatively coupled to a processing device (e.g., a digital signal processor (DSP) or a central processing unit (CPU)) that includes logic circuits programmed to implement a beamformer for calculating an estimate of the sound source. The sound signal received at any microphone sensor in the microphone array may include a noise component and a delayed component with respect to the sound signal received at a reference microphone sensor (e.g., a first microphone sensor in the microphone array). A beamformer is a spatial filter that is implemented on a hardware processor based on certain optimization rules and can be used to identify the sound source based on the multiple versions of the sound signal received at the microphone array.

The sound signal emitted from a sound source can be broadband signals such as, for example, speech and audio signals, typically in the frequency range from 20 Hz to 20 KHz. Some implementations of the beamformers are not effective in dealing with noise components at low frequencies because the beam-widths (i.e., the widths of the main lobes in the frequency domain) associated with the beamformers are inversely proportional to the frequency. To counter the non-uniform frequency response of beamformers, differential microphone arrays (DMAs) have been used to achieve frequency-invariant beam patterns and high directivity factors (DFs), where the DF describes sound intensity with respect to direction angles. DMAs may contain an array of microphone sensors that are responsive to the spatial derivatives of the acoustic pressure field. For example, the outputs of a number of geographically arranged omnidirectional sensors may be combined together to measure the differentials of the acoustic pressure fields among microphone sensors. Compared to additive microphone arrays, DMAs allow for small inter-sensor distance, and may be manufactured in a compact manner.

DMAs can measure the derivatives (at different orders) of the acoustic fields received by the microphones. For example, a first-order DMA, formed using the difference between a pair of adjacent microphones, may measure the first-order derivative of the acoustic pressure fields, and the second-order DMA, formed using the difference between a pair of adjacent first-order DMAs, may measure the second-order derivatives of acoustic pressure field, where the first-order DMA includes at least two microphones, and the second-order DMA includes at least three microphones. Thus, an N-th order DMA may measure the N-th order derivatives of the acoustic pressure fields, where the N-th order DMA includes at least N+1 microphones. The N-th order is referred to as the differential order of the DMA. The directivity factor of a DMA may increase with the order of the DMA.

The microphone sensors in a DMA can be arranged either along a straight line (referred to as linear DMA) or along a curve. The curve may can be an ellipse and in particular, a circle (the corresponding DMA is referred to as circular DMA). Compared to linear DMA (LDMA), the circular DMA (CDMA) can be steered easily and have a substantially identical performance for sound signals from different directions. This is useful in situations such as, for example, when the sound comes from directions other than along a straight line (or the endfire direction).

CDMAs may include omnidirectional microphones placed on a planar surface substantially along the trace of a circle. An omnidirectional microphone is a microphone that picks up sound with equal gain from all sides or directions with respect to the microphone. CDMAs, however, may amplify white noise associated with the captured signals. The white noise may come from the device noise. Minimum-norm filters have been used to improve the white noise gain (WNG) by increasing the number of microphones used in a microphone array given the DMA order. Although a large number of microphones deployed in a microphone array may improve the WNG, the large number of microphones associated with the minimum-norm filters may result in a larger array aperture, and consequently, more nulls in lower frequency bands. A null is created when the responses from different frequency bands, when combined, cancel each other. The nulls may produce undesirable dead regions in the frequency response of the minimum-norm beamformers associated with CDMAs.

Concentric circular differential microphone arrays (CCDMAs) have been used to address the deficiencies of CDMAs. CCDMAs may include more than one circular rings of microphones, where each circular ring may include an identical number of microphones and all these rings may be concentric with respect to a common center. Further, the microphones of CCDMAs may be uniformly distributed on each one of the rings such that the microphones are aligned along radiating lines that partition the circles into each portions. Compared to the CDMAs where a single ring of microphones are used to form the microphone array, the CCDMAs may improve the WNG and eliminate the nulls. The current design of CCDMAs and the associated beamformers relies on the structure that each ring includes an identical number of uniformly-distributed microphones with respect to a center. Because CCDMAs includes rings having identical number of microphones on each ring, each ring needs to include 2 N+1 microphones on each ring to construct an Nth-order DMA. Thus, the inner most ring includes the same number of microphones as the outer most ring. However, the inner rings occupy much smaller area compared to the outer rings. Because each microphone occupies a certain amount of area, it is not practical to place a large number of microphones on the inner circles. This limitation prevents CCDMAs from being deployed in compact devices where the inner ring circles are small and cannot accommodate the same number of microphones as the outer ring circles. Further, CCDMAs require that microphones of different rings are aligned. This requirement may further limit the design of CCDMAs.

As the cost microphones and the cost for the hardware to process signals captured by the microphone arrays become more affordable, the DMA are designed into a wide range of intelligent systems to provide an interface with human users. Due to the restriction of the product designs, the microphone array may be limited to a compact area which may obstruct the construction of CCDMAs.

To overcome the above-identified and other deficiencies, implementations of the present disclosure provide a technical solution that may include a multi-ringed CDMA and an associated beamformer. The multi-ringed CDMA may include multiple circular rings of microphones. Compared to CCDMAs, each ring of the multi-ringed CDMA may include varying numbers of microphones, thus allowing the placement of fewer microphones on the inner rings. Further, the multi-ringed CDMA does not require that microphones on different rings being aligned along radiating lines because different rings may be associated with different numbers of microphones. Thus, the multi-ringed CDMA provides the flexibility for product design as it has fewer restrictions on the number of microphones on different rings and fewer restrictions on the placements of microphones on these rings.

Implementations of the disclosure may further provide a beamformer that matches the structure of the multi-ringed CDMA. To this end, the beam pattern associated with each ring of the multi-ringed CDMA can be represented by an approximation including a series of harmonics (e.g., using the Jacobi-Anger expansion), where the order of the representation is determined by the number of microphones in the ring. Thus, the outer rings may include more microphone associated with higher-order beamformers; the inner rings may include fewer microphones associated with lower-order beamformers. To achieve an N-th order beamformer, at least one of the rings includes at least 2 N+1 microphones. Based on these approximations, implementations may calculate an Nth order beamformer for the multi-ringed CDMA that may meet certain optimization criteria. In this way, implementations may achieve flexible multi-ringed CDMA structures that can be implemented in a wide range of product designs.

FIG. 1 illustrates a multi-ringed circular differential microphone array (MR-CDMA) system 100 according to an implementation of the present disclosure. As shown in FIG. 1, system 100 may include a MR-CDMA 102, an analog-to-digital converter (ADC) 104, and a processing device 106. MR-CDMA 102 may include multiple rings of CDMAs that are arranged on a common plenary platform. Each CDMA ring may include one or more of microphones placed substantially along a circle with respect to a common central point (O). As shown in FIG. 1, MR-CDMA 102 may include P (P=3) rings, wherein the p-th (p=1, 2, 3) ring may have a radius of $r_p$ and include $M_p$ omnidirectional microphones.

The microphone sensors in MR-CDMA 102 may receive acoustic signals originated from a sound source from a certain distance. In one implementation, the acoustic signal may include a first component from a sound source (s(t)) and a second noise component (v(t)) (e.g., ambient noise), wherein t is the time. Due to the spatial distance between microphone sensors, each microphone sensor may receive a different version of the sound signal (e.g., with different amount of delays with respect to a reference point such as, for example, a designated microphone sensor in MR-CDMA 102 or the origin (O)) in addition to the noise component.

Figure 2:
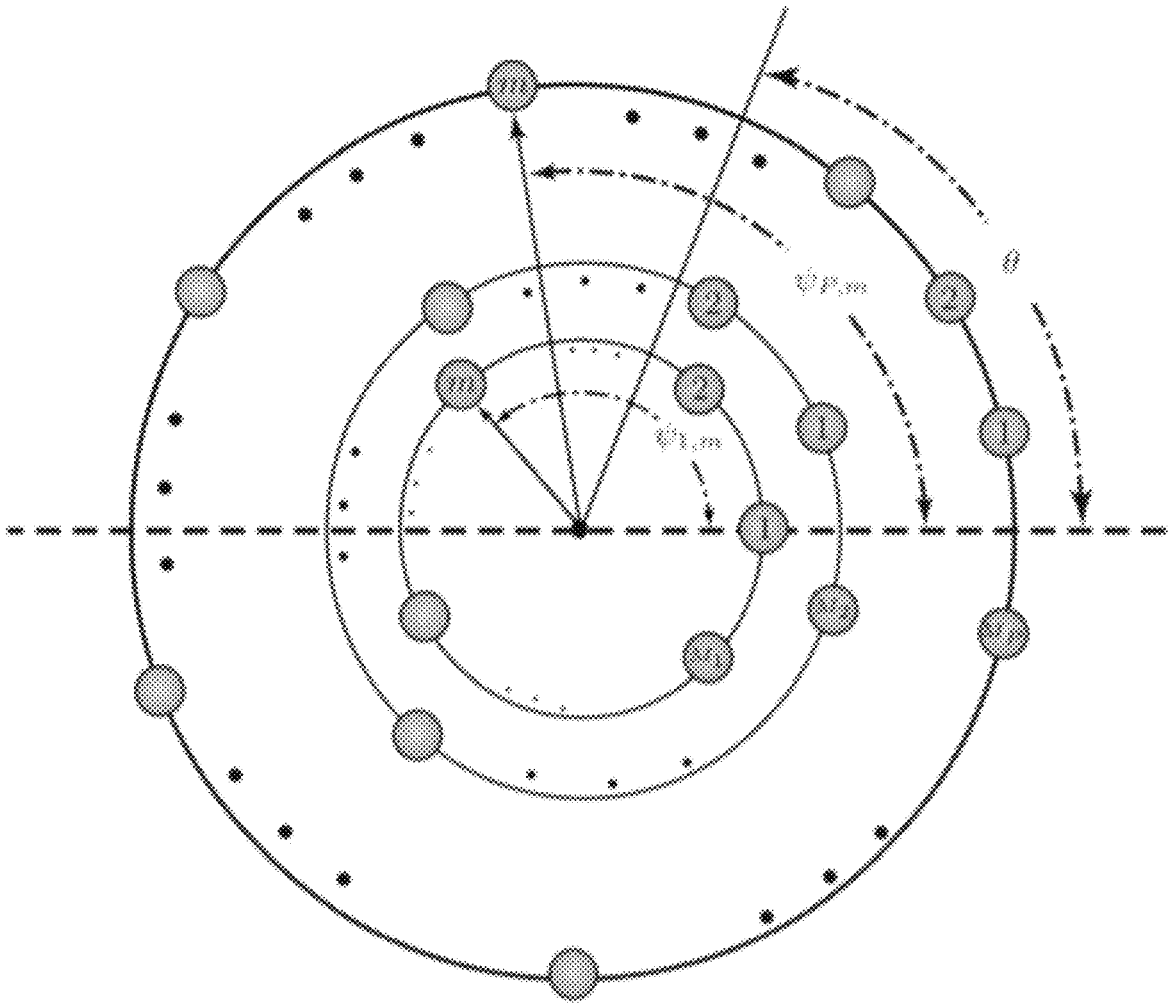
FIG. 2 shows a detailed arrangement of a multi-ringed microphone array according to an implementation of the present disclosure.

FIG. 2 illustrates a detailed arrangement of a multi-ringed microphone array 200 according to an implementation of the present disclosure. Multi-ringed array 200 may include a P rings of microphones, placed on the x-y plane, where the p-th (p=1, 2, . . . , P) ring, with a radius of $r_p$, including $M_p$ microphones (e.g., omnidirectional microphones). For the p-th ring, the Mp microphones are uniformly arranged along the circle of the p-th ring, or the microphones on the p-th ring are separate from their neighboring microphones at a substantially equal amount of angular distance. For the simplicity and convenience of discussion, it is assumed that the center of the multi-ringed array 200 coincides with the origin of the two-dimensional Cartesian coordinate system, and that azimuthal angles are measured anti-clockwise from the x axis, and the first microphone (#1) of the first ring of the array is placed on the x axis as shown in FIG. 2.

FIG. 2 is for illustration purpose. Implementations of the present disclosure are not limited to the arrangement as shown in FIG. 2. For example, the first microphone of different rings within the multi-ringed array 200 may be placed at different angles with respect to the x-axis, and each ring may include different numbers of microphones. As such, an inner ring may include fewer microphones than an outer ring. This flexibility, however, is not a requirement. In certain situations, an inner ring may include more microphones than an outer ring. In one implementation, the multiple rings of microphones may share a common center O.

Thus, the coordinates of the $m^{th}$ microphone in the $p^{th}$ ring can be represented as $$r_{p,m}=(r_p \cos \Psi_{p,m}, r_p \sin \Psi_{p,m}),$$

where p=1, 2, . . . , P, m=1, 2, . . . , Mp, and $$\psi_{p,m} = \psi_{p,1} + \frac{2\pi(m-1)}{M_p}$$

is the angular position of the $m^{th}$ microphone on the $p^{th}$ ring, where the Mp microphones on the p-th ring are placed uniformly along the p-th circle, with $\Psi_{p,1}>0$ being the angular position of the first microphone of the p-th ring. Further, it is assumed that a source signal (plane wave) located in the far-field impinges on the multi-ringed array 200 from the direction (azimuth angle) θ, at the speed of sound (C) in the air, e.g., C=340 m/s.

Multi-ringed array 200 may be associated with a steering vector that characterizes the multi-ringed array 200. The steering vector may represent the relative phase shifts for the incident far-field waveform across the microphones in multi-ringed array 200. Thus, the steering vector is the response of multi-ringed 200 to an impulse input. For multi-ringed 200 that have P rings where each ring has a number ($M_p$) of microphones, the length of a steering vector is $\underline{M}=\Sigma_{p=1}^{P}M_p$ or the total number of microphones in multi-ringed array 200. The steering vector can be defined as $$\underline{d}(\omega, \theta) = [d_1^T(\omega, \theta) d_2^T(\omega, \theta) \ldots d_P^T(\omega, \theta)]^T, \text{ where}$$

$$d_p(\omega, \theta) = \left[ e^{j\overline{\omega_p}\cos(\theta-\psi_{p,1})} \quad e^{j\overline{\omega_p}\cos(\theta-\psi_{p,2})} \ldots \quad e^{j\overline{\omega_p}\cos(\theta-\psi_{p,M_p})} \right]^T$$

is the p-th ring's steering vector, the superscript T is the transpose operator, j is the imaginary unit where $j^2=-1$, and $$\overline{\omega_p} = \frac{\omega r_p}{c},$$

where ω=2 πf is the angular frequency, f>0 is the temporal frequency, and $r_p$ is the radius for the r-th ring. In one implementation, the inter-element spacing (i.e., Euclidean distance between two adjacent microphones) is less than half acoustic wavelength to avoid spatial aliasing.

For convenience, microphones in different rings may be labeled as $m_{p,k}$, where p=1, 2, . . . P represent the index of the ring on which the microphone is located, and k=1, . . . , $M_p$ represent the index for a microphone on the p-th ring. Thus, microphone $m_{p,k}$ denotes the k-th microphone on the p-th ring. Microphones $m_{p,k}$, where k=1, . . . , $M_p$ and p=1, 2, . . . P, may respectively receive an acoustic signal $a_{p,k}(t)$ originated from a sound source, where t is the time, k=1, . . . , $M_p$, and p=1, 2, . . . P.

Referring to FIG. 1, each microphone may receive a version of an acoustic signal $a_{p,k}(t)$ that may include a delayed copy of the sound source represented as $s(t+d_{p,k})$ and a noise component represented as $v_{p,k}(t)$, wherein t is the time, k=1, . . . , $M_p$, p=1, 2, . . . P, $d_{p,k}$ is the time delay for the acoustic signal received at microphone $m_{p,k}$ to a reference microphone (e.g., $M_{1,,1}$), and $v_{p,k}(t)$ represents the noise component at microphone $m_{p,k}$. The electronic circuit of microphone $m_{p,k}$ of MR-CDMA 102 may convert $a_{p,k}(t)$ into electronic signals $ea_{p,k}(t)$ that may be fed into the ADC 104, wherein k=1, . . . , $M_p$, p=1, 2, . . . P. In one implementation, the ADC 104 may further convert the electronic signals $ea_{p,k}(t)$ into digital signals $y_{p,k}(t)$. The analog to digital conversion may include quantize the input $ea_{p,k}(t)$ into discrete values $y_{p,k}(t)$.

In one implementation, the processing device 106 may include an input interface (not shown) to receive the digital signals $y_{p,k}(t)$, and as shown in FIG. 1, the processing device may be programmed to identify the sound source by performing a MR-CDMA beamformer 110. To perform MR-CDMA beamformer 110, in one implementation, the processing device 106 may implement a pre-processor 108 that may further process the digital signal $y_{p,k}(t)$ for MR-CDMA beamformer 110. The pre-processor 108 may include hardware circuits and software programs to convert the digital signals $y_{p,k}(t)$ into frequency domain representations using such as, for example, short-time Fourier transforms (STFT) or any suitable type of frequency transforms. The STFT may calculate the Fourier transform of its input signal over a series of time frames. Thus, the digital signals $y_{p,k}(t)$ may be processed over the series of time frames.

In one implementation, the pre-processing module 108 may perform STFT on the input $y_{p,k}(t)$ associated with microphone $m_{p,k}$ of MR-CDMA 102 and calculate the corresponding frequency domain representation $Y_{p,k}(\omega)$, wherein ω(ω=2 πf) represents the angular frequency domain, k=1, . . . , $M_p$, p=1, 2, . . . P. In one implementation, MR-CDMA beamformer 110 may receive frequency representations $Y_{p,k}(\omega)$ of the input signals $y_{p,k}(t)$ and calculate an estimate Z(ω) in the frequency domain for the sound source (s(t)). The frequency domain may be divided into a number (L) of frequency sub-bands, and the MR-CDMA beamformer 110 may calculate the estimate Z(ω) for each of the frequency sub-bands.

The processing device 106 may also include a post-processor 112 that may convert the estimate $Z(\omega)$ for each of the frequency sub-bands back into the time domain to provide the estimate sound source represented as $X_1(t)$. The estimated sound source $X_1(t)$ may be determined with respect to the source signal received at a reference microphone (e.g., microphone $m_{1,1}$) in MR-CDMA 102.

Implementations of the present disclosure may include different types of MR-CDMA beamformers that can calculate the estimated sound source $X_1(t)$ using the acoustic signals captured by MR-CDMA 102. The performance of the different types of beamformers may be measured in terms of signal-to-noise ratio (SNR) gain and a directivity factor (DF) measurement. The SNR gain is defined as the signal-to-noise ratio at the output (oSNR) of MR-CDMA 102 compared to the signal-to-noise ratio at the input (iSNR) of MR-CDMA 102. When each of microphones $m_{p,k}$ is associated with white noise including substantially identical temporal and spatial statistical characteristics (e.g., substantially the same variance), the SNR gain is referred to as the white noise gain (WNG). This white noise model may represent the noise generated by the hardware elements in the microphone itself. Environmental noise (e.g., ambient noise) may be represented by a diffuse noise model. In this scenario, the coherence between the noise at a first microphone and the noise at a second microphone is a function of the distance between these two microphones.

The SNR gain for the diffuse noise model is referred to as the directivity factor (DF) associated with MR-CDMA 102. The DF quantifies the ability of the beamformer in suppressing spatial noise from directions other than the look direction. The DF associated with MR-DMA 102 may be written as:

$$D[h(\omega)] = \frac{|\underline{h}^H(\omega)\underline{d}(\omega, \theta_s)|^2}{\underline{h}^H(\omega)\Gamma_d(\omega)\underline{h}(\omega)},$$

where $\underline{h}(\omega)=[h_1^T(\omega)h_2^T(\omega)\ldots h_p^T(\omega)]^T$ is the global filter for the beamformer associated with MR-DMA 102, wherein $h_p(\omega)=[H_{p,1}(\omega)\ H_{p,2}(\omega)\ldots H_{p,\mathcal{M}_p}(\omega)]^T$ is the spatial filter of length $M_p$ for the p-th ring, and the superscript H represents the conjugate-transpose operator, and $[H_{p,1}(\omega)\ H_{p,2}(\omega)\ldots H_{p,\mathcal{M}_p}(\omega)]^T$ are the spatial filter of $M_p$ microphones of the p-th ring, and where $\Gamma_d(\omega)$ is the pseudo-coherence matrix of the noise signal in a diffuse (spherically isotropic) noise field, and the (i, j)th element of $\Gamma_d(\omega)$ is $$|\Gamma_d(\omega)|_{ij} = \mathrm{sinc}\left(\frac{\omega\delta_{ij}}{c}\right),$$

where $\delta_{ij}=\|r_i-r_j\|$, is the distance between microphone i and microphone j, and $\|\cdot\|$ is the Euclidean norm and $r_i, r_j \in \{r_{1,1}, r_{1,2}, \ldots, r_{p,\mathcal{M}_p}, \ldots, r_{P,\mathcal{M}_p}\}$ are the coordinates of the microphones.

Additionally, MR-CDMA 102 may be associated with a beampattern (or directivity pattern) that reflects the sensitivity of the beamformer to a plane wave impinging on MR-CDMA 102 from a certain angular direction θ. The beampattern for a plane wave impinging from an angle θ for a beamformer represented by a filter $\underline{h}(\omega)$ associated with MR-CDMA 102 can be defined as $$B[\underline{h}(\omega), \theta] = \underline{h}^H(\omega)\underline{d}(\omega) = \sum_{p=1}^{P}\sum_{m=1}^{M_p} H_{p,m}^*(\omega)e^{j\overline{\omega}_p\cos(\theta-\psi_{p,m})}$$

where $\underline{h}(\omega)=[h_1^T(\omega)\ldots h_p^T(\omega)]^T$ is the global filter for the beamformer associated with MR-CDMA 102, and the superscript H represents the conjugate-transpose operator, and $[H_{p,1}(\omega)H_{p,2}(\omega)\ldots H_{p,\mathcal{M}_p}(\omega)]^T$ are the spatial filters of length $M_p$ for the p-th ring.

In one implementation, the beampattern is substantially frequency-invariant. MR-CDMA 102 associated with a frequency-invariant beampattern may be used to acquire high fidelity speech and audio signals. Microphone arrays with non-frequency-invariant beampatterns may include distortions in the signal of interest after beamforming.

It is desirable to steer the beampattern to the direction $\theta_s$ which is the incident angle of the sound signal. The corresponding frequency-invariant beampattern can be written as $B(a_N, \theta-\theta_s)=\Sigma_{n=0}^{N} a_{N,n}\cos(n(\theta-\theta_s))$, where $a_{N,n}$ are the real coefficients that determines the different directivity patterns of the Nth-order DMA. The $B(a_N, \theta-\theta_s)$ may be rewritten as:

$$B(b_{2N}, \theta-\theta_s)=\Sigma_{n=-N}^{N} b_{2N,n}e^{jn(\theta-\theta_s)}=[\Upsilon(\theta_s)b_{2N}]^T P_e(\theta) = c_{2N}^T(\theta_s)P_e(\theta),$$

where $b_{2N,0}=a_{N,0}$, $b_{2N,i}=\frac{1}{2}a_{N,i}$, $i=\pm1, \pm2, \ldots, \pm N$, $$\Upsilon(\theta_s)=\mathrm{diag}(e^{jN\theta_s}, \ldots, 1, \ldots, e^{-jN\theta_s})$$

is a (2 N+1)×(2 N+1) diagonal matrix and $$b_{2N}=[b_{2N,-N}\ldots b_{2N,0}\ldots b_{2N,N}]^T,$$

$$P_e(\theta)=[e^{-jN\theta}\ldots 1\ldots e^{jN\theta}]^T,$$

$$c_{2n}(\theta_s)=\Upsilon(\theta_s)b_{2N}=[c_{2N,-N}(\theta_s)\ldots c_{2N,0}(\theta_s)\ldots c_{2N,N}(\theta_s)]^T,$$

are vectors of length 2N+1, respectively, and $c_{2n}(\theta_s)$ is the target beampattern. The main beam points in the direction of $\theta_s$ and $B(b_{2N}, \theta-\theta_s)$ is symmetric with respect to the axis $\theta_s \Leftrightarrow \theta_s+\pi$.

In the implementations of CCDMA, each ring is approximated by a N-th order Jacobi-Anger expansion. As discussed above, this approach that requires the same number of microphones for different rings makes it difficult to deploy CCDMAs in a compact space where the inner rings may not have enough space to accommodate the same number of microphones as the outer rings, thus preventing CCDMAs from being used in certain situations. To overcome this and other deficiencies of CCDMAs, implementations of the present disclosure provide for a beamformer that can accommodate different numbers of microphones in different rings, thus allowing fewer microphones in the inner rings than the outer rings. The beampattern for each ring may be approximated based on the number of microphones in that ring:

$$e^{j\overline{\omega}_p\cos(\theta-\Psi_{p,m})}\approx\Sigma_{n=-N_p}^{N_p}\beta_n(\overline{\omega}_p)e^{jn(\theta-\Psi_{p,m})}.$$

In this case, the $p^{th}$ ring includes at least 2 $N_p$+1 microphones. In one implementation, to design an Nth-order symmetric beampattern, at least one ring include 2 N+1 microphones to support the Nth-order Jacobi-Anger expansion, i.e., $$\max\{N_p, p=1, 2, \ldots, N_P\}\geq N.$$

The outer rings may include more microphones. In on implementation, an outer ring is approximated with a higher Jacobi-Anger expansion than an inner ring, i.e., in a descending order from $N_1 \leq N_2 \leq \ldots \leq N_P$. In another implementation, the order of Jacobi-Anger expansions is any order from the outer ring to the inner ring at long as at least one ring is associated with an Nth-order Jacobi-Anger approximation.

$$B[\underline{h}(\omega), \theta] = \sum_{p=1}^{P}\sum_{m=1}^{M_p} H^*_{p,m}(\omega)e^{j\overline{\omega}_p \cos(\theta-\psi_{p,m})} \approx \sum_{p=1}^{P}\sum_{m=1}^{M_p} H^*_{p,m}(\omega)\sum_{n=-N_P}^{N_P}\beta_n(\overline{\omega}_p)e^{jn(\theta-\psi_{p,m})}.$$

When written as follows:

$$e^{jn(\theta-\psi_{p,m})} = \sum_{n=-N}^{N}\beta'_n(\omega_p)e^{jn(\theta-\psi_{p,m})},$$

where N is the highest order, $\beta'_n(\overline{\omega}_p)=\alpha_{p,n}\beta_n(\overline{\omega}_p)$ with $$\alpha_{p,n} = \begin{cases} 1, n = \pm 1, \pm 2, \ldots, \pm N_p \\ 0, n = \pm(N_p+1), \pm(N_p+2), \ldots, \pm N \end{cases}$$

being binary coefficients. Substituting this representation, the beampattern can be written as:

$$B[\underline{h}(\omega), \theta] = \sum_{n=-N}^{N} e^{jn\theta} j^n \sum_{p=1}^{P}\alpha_{p,n}J_n(\overline{\omega}_p)\sum_{m=1}^{M_p} e^{-jn\psi_{p,m}}H^*_{p,m}(\omega) = \sum_{n=-N}^{N} e^{jn\theta}c_{2N,n}(\theta_s)$$

where $J_n(\overline{\omega}_p)$ is the N-th order Bessel function of the first kind with $J_{-n}(\overline{\omega}_p)=(-1)^n J_n(\overline{\omega}_p)$. As such to achieve the target beampattern, $$j^n\sum_{p=1}^{P}\alpha_{p,n}J_n(\overline{\omega}_p)\psi^T_{n,p}h^*_p(\omega) = c_{2N,n}(\theta_s)$$

where n=±1, ±2, . . . , ±N, and $$\psi_{n,p} = \left[\, e^{-jn\psi_{p,1}} \quad e^{-jn\psi_{p,2}} \quad \ldots \quad e^{-jn\psi_{p,M_P}} \,\right]^T$$

is a vector of length $M_P$. Written in vector form, $$j^n\underline{\Psi}_n^T(\omega)\underline{h}^*(\omega)=c_{2N,n}(\theta_s), n=\pm 1, \pm 2, \ldots, \pm N,$$

where $\underline{\Psi}_n^T=[\alpha_{1,n}J_n(\omega)\Psi_{n,1}^T, \alpha_{2,n}J_n(\omega)\Psi_{n,2}^T, \ldots, \alpha_{P,n}J_n(\omega)\Psi_{n,P}^T]^T$ is a vector of length $\underline{M}$. Thus, the beamforming filters can be obtained by solving $$\underline{\Psi}(\omega)\underline{h}(\omega)=J^*\Upsilon^*(\theta_s)b_{2N},$$

where $$J = \mathrm{diag}\left[\frac{1}{j^{-N}}, \ldots, 1, \ldots, \frac{1}{j^N}\right]$$

is a (2 N+1)×(2 N+1) diagonal matrix and $$\underline{\Psi}(\omega) = \begin{bmatrix} \psi^H_{-N}(\omega) \\ \vdots \\ \psi^H_0(\omega) \\ \vdots \\ \psi^H_N(\omega) \end{bmatrix}$$

is a (2 N+1)×M matrix, which is of full column rank. The minimum norm solution leads to $$\underline{h}_{MN}(\omega)=\Psi^H(\omega)[\underline{\Psi}(\omega)\underline{\Psi}^H(\omega)]^{-1}J^*\Upsilon^*(\theta_s)b_{2N}.$$

where $\underline{h}_{MN}(\omega)$ may represent the MR-CDMA beamformer 110 associated with MR-CMDA 102. The MR-CDMA beamformer 110 can provide more flexibility to the design of MR-CMDA 102 because the beamformer 110 allows fewer microphones on the inner rings and does not require that microphones on different rings be aligned.

Figure 3:
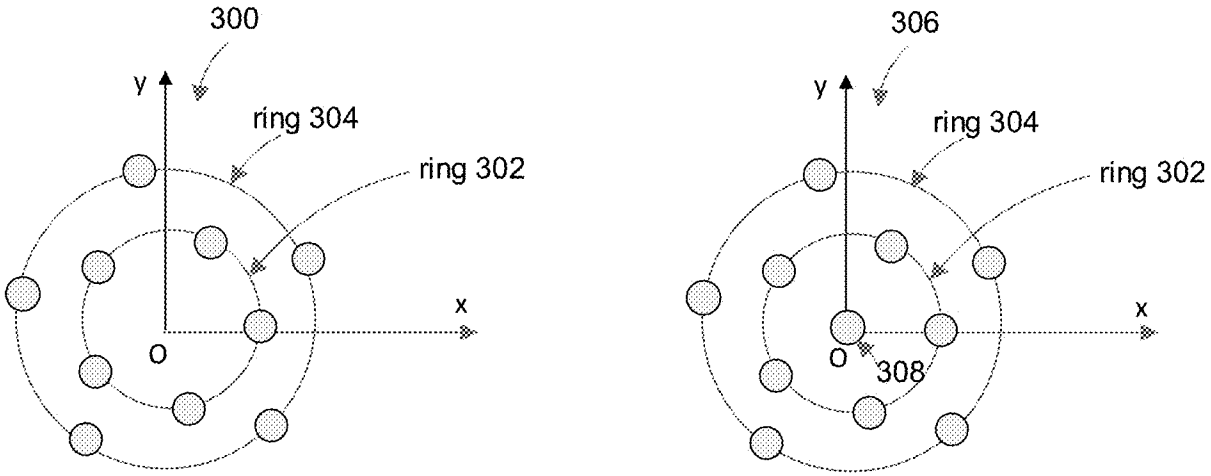
FIG. 3 shows two exemplary MR-CDMAs according to implementations of the present disclosure.

MR-CDMA beamformer 110 can include different numbers of rings, and each ring may include different numbers of microphones. The performance of MR-CDMA beamformer 110 may depend on the number of rings, the number of microphones in each ring, the radii of rings etc. FIG. 3 shows two exemplary MR-CDMAs according to implementations of the present disclosure. MR-CDMA 300 as shown in FIG. 3 includes an inner ring 302 and an outer ring 304. Each ring may include five (5) microphones. In addition to inner ring 302 and outer ring 304, MR-CDMA 306 further includes a center microphone 308. In one implementation, the radius of outer ring 304 is set at 3.0 cm while the radius of the inner ring 302 may be adjusted between 1.5 cm and 3.0 cm. The experimental results show that the effects of the zeros of the $0^{th}$ order Bessel function decrease because the zeros of ring 302 and ring 304 occur at different frequencies. Further, a center microphone 308 may further boost the frequency response of MR-CDMA 306, thus improving the performance of MR-CDMAs. The experimental results further show that even when the microphones on different rings are not aligned, the frequency response of MR-CDMA is still substantially frequency-invariant.

For conciseness of discussion, MR-CDMAs are described using circular rings. However, MR-CDMAs are not limited to circular rings. For example, the ring shape can be ellipses or any suitable geometric shapes.

Figure 4:
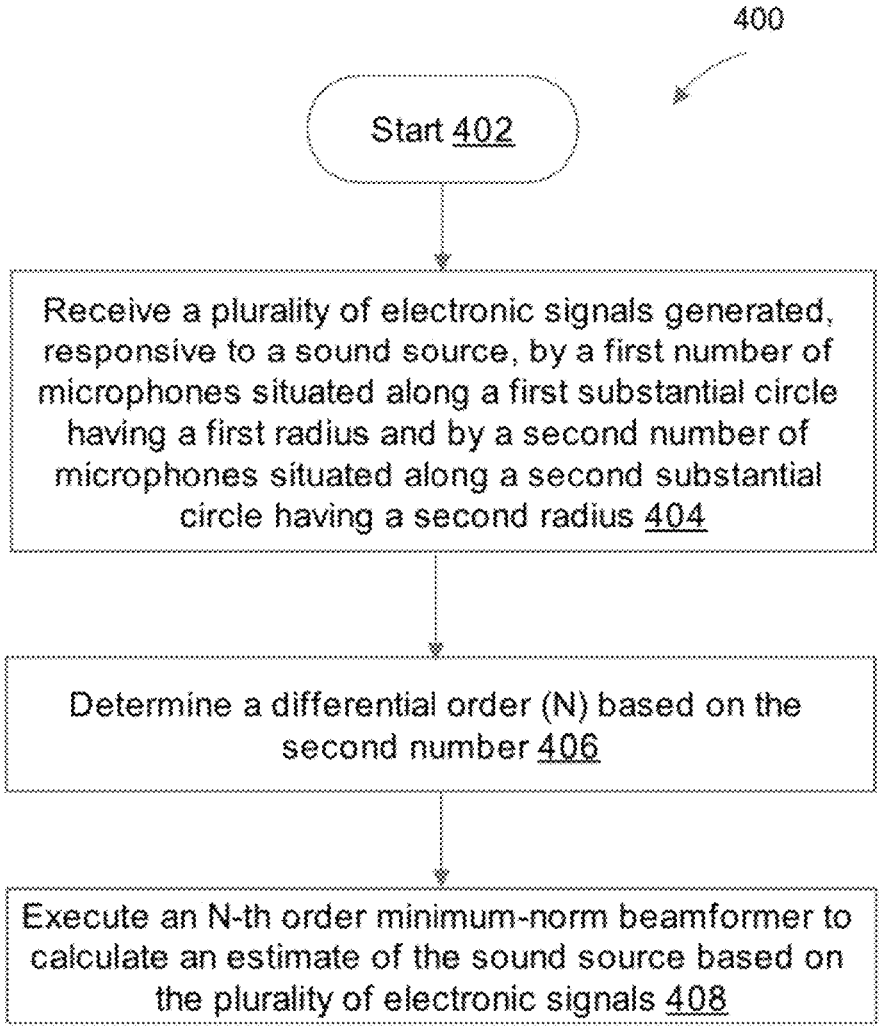
FIG. 4 is a flow diagram illustrating a method to estimate a sound source using a beamformer associated with a MR-CDMA according to some implementations of the disclosure.

FIG. 4 is a flow diagram illustrating a method 400 to estimate a sound source using a beamformer associated with a multi-ringed circular differential microphone array (MR-CDMA) according to some implementations of the disclosure. The method 400 may be performed by processing logic that comprises hardware (e.g., circuitry, dedicated logic, programmable logic, microcode, etc.), software (e.g., instructions run on a processing device to perform hardware simulation), or a combination thereof.

For simplicity of explanation, methods are depicted and described as a series of acts. However, acts in accordance with this disclosure can occur in various orders and/or concurrently, and with other acts not presented and described herein. Furthermore, not all illustrated acts may be required to implement the methods in accordance with the disclosed subject matter. In addition, the methods could alternatively be represented as a series of interrelated states via a state diagram or events. Additionally, it should be appreciated that the methods disclosed in this specification are capable of being stored on an article of manufacture to facilitate transporting and transferring such methods to computing devices. The term article of manufacture, as used herein, is intended to encompass a computer program accessible from any computer-readable device or storage media. In one implementation, the methods may be performed by the MR-CDMA beamformer 110 executed on the processing device 106 as shown in FIG. 1.

Referring to FIG. 4, at 402, the processing device may start executing operations to calculate an estimate for a sound source such as a speech source. The sound source may emit sound that may be received by a microphone array including multiple rings of microphones that may convert the sound into sound signals. The sound signals may be electronic signals including a first component of the sound and a second component of noise. Because the microphone sensors are commonly located on a planar platform and are separated by spatial distances, the first components of the sound signals may vary due to the temporal delays of the sound arriving at the microphone sensors.

At 404, the processing device may receive a plurality of electronic signals generated, responsive to a sound source, by a first number of microphones situated along a first substantial circle having a first radius and by a second number of microphones situated along a second substantial circle having a second radius, wherein a multi-ringed differential microphone array comprises the first number of microphones and the second number of microphones located on a substantially planar platform, and wherein the first number is smaller than the second number.

At 406, the processing device may determine a differential order (N) based on the second number.

At 408, the processing device may execute an N-th order minimum-norm beamformer to calculate an estimate of the sound source based on the plurality of electronic signals.

Figure 5:
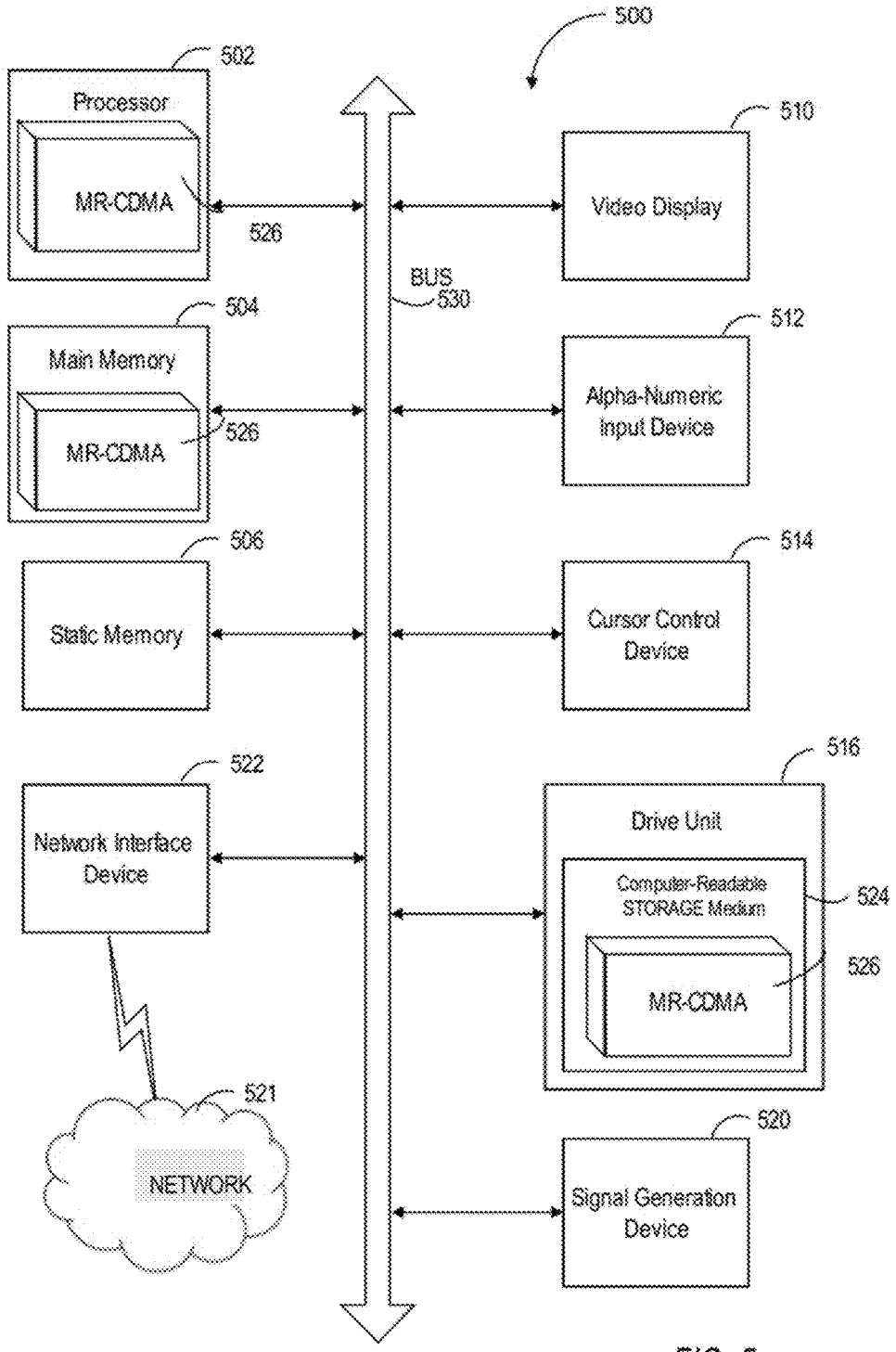
FIG. 5 is a block diagram illustrating an exemplary computer system, according to some implementations of the present disclosure.

FIG. 5 illustrates a diagrammatic representation of a machine in the exemplary form of a computer system 500 within which a set of instructions for causing the machine to perform any one or more of the methodologies discussed herein, may be executed. In alternative implementations, the machine may be connected (e.g., networked) to other machines in a LAN, an intranet, or the Internet. The machine may operate in the capacity of a server or a client machine in a client-server network environment, or as a peer machine in a peer-to-peer (or distributed) network environment. The machine may be a personal computer (PC), a tablet PC, a set-top box (STB), a Personal Digital Assistant (PDA), a cellular telephone, a web appliance, a server, a network router, switch or bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The exemplary computer system 500 includes a processing device (processor) 502, a main memory 504 (e.g., read-only memory (ROM), flash memory, dynamic random access memory (DRAM) such as synchronous DRAM (SDRAM) or Rambus DRAM (RDRAM), etc.), a static memory 506 (e.g., flash memory, static random access memory (SRAM), etc.), and a data storage device 518, which communicate with each other via a bus 508.

Processor 502 represents one or more general-purpose processing devices such as a microprocessor, central processing unit, or the like. More particularly, the processor 502 may be a complex instruction set computing (CISC) microprocessor, reduced instruction set computing (RISC) microprocessor, very long instruction word (VLIW) microprocessor, or a processor implementing other instruction sets or processors implementing a combination of instruction sets. The processor 502 may also be one or more special-purpose processing devices such as an application specific integrated circuit (ASIC), a field programmable gate array (FPGA), a digital signal processor (DSP), network processor, or the like. The processor 502 is configured to execute instructions 526 for performing the operations and steps discussed herein.

The computer system 500 may further include a network interface device 522. The computer system 500 also may include a video display unit 510 (e.g., a liquid crystal display (LCD), a cathode ray tube (CRT), or a touch screen), an alphanumeric input device 512 (e.g., a keyboard), a cursor control device 514 (e.g., a mouse), and a signal generation device 520 (e.g., a speaker).

The data storage device 518 may include a computer-readable storage medium 524 on which is stored one or more sets of instructions 526 (e.g., software) embodying any one or more of the methodologies or functions described herein (e.g., processing device 102). The instructions 526 may also reside, completely or at least partially, within the main memory 504 and/or within the processor 502 during execution thereof by the computer system 500, the main memory 504 and the processor 502 also constituting computer-readable storage media. The instructions 526 may further be transmitted or received over a network 574 via the network interface device 522.

While the computer-readable storage medium 524 is shown in an exemplary implementation to be a single medium, the term "computer-readable storage medium" should be taken to include a single medium or multiple media (e.g., a centralized or distributed database, and/or associated caches and servers) that store the one or more sets of instructions. The term "computer-readable storage medium" shall also be taken to include any medium that is capable of storing, encoding or carrying a set of instructions for execution by the machine and that cause the machine to perform any one or more of the methodologies of the present disclosure. The term "computer-readable storage medium" shall accordingly be taken to include, but not be limited to, solid-state memories, optical media, and magnetic media.

In the foregoing description, numerous details are set forth. It will be apparent, however, to one of ordinary skill in the art having the benefit of this disclosure, that the present disclosure may be practiced without these specific details. In some instances, well-known structures and devices are shown in block diagram form, rather than in detail, in order to avoid obscuring the present disclosure.

Some portions of the detailed description have been presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "segmenting", "analyzing", "determining", "enabling", "identifying," "modifying" or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

The disclosure also relates to an apparatus for performing the operations herein. This apparatus may be specially constructed for the required purposes, or it may include a general purpose computer selectively activated or reconfigured by a computer program stored in the computer. Such a computer program may be stored in a computer readable storage medium, such as, but not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions.

The words "example" or "exemplary" are used herein to mean serving as an example, instance, or illustration. Any aspect or design described herein as "example' or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an embodiment" or "one embodiment" or "an implementation" or "one implementation" throughout is not intended to mean the same embodiment or implementation unless described as such.

Reference throughout this specification to "one implementation" or "an implementation" means that a particular feature, structure, or characteristic described in connection with the implementation is included in at least one implementation. Thus, the appearances of the phrase "in one implementation" or "in an implementation" in various places throughout this specification are not necessarily all referring to the same implementation. In addition, the term "or" is intended to mean an inclusive "or" rather than an exclusive "or."

It is to be understood that the above description is intended to be illustrative, and not restrictive. Many other implementations will be apparent to those of skill in the art upon reading and understanding the above description. The scope of the disclosure should, therefore, be determined with reference to the appended claims, along with the full scope of equivalents to which such claims are entitled.

What is claimed is:

1. A multi-ringed differential microphone array comprising:

a first number of microphones situated along a first substantial circle having a first radius;

a second number of microphones situated along a second substantial circle having a second radius, wherein the first number of microphones and the second number of microphones are located on a substantially planar platform, and wherein the first number is smaller than the second number; and a processing device, communicatively coupled to the first number microphones and the second number of microphones, to receive a plurality of electronic signals generated by the first number of microphones and the second number of microphones;

determine a differential order (N) based on the second number; and execute an N-th order minimum-norm beamformer to calculate an estimate of the sound source based on the plurality of electronic signals.

2. The multi-ringed differential microphone array of claim 1, wherein each one of the plurality of electronic signals represents a respective version of the sound source received at a corresponding one of the plurality of microphones.

3. The multi-ringed differential microphone array of claim 1, further comprising:

an analog-to-digital converter, communicatively coupled to the first number of microphones, the second number of microphones, and the processing device, to convert the plurality of electronic signals into a plurality of digital signals for the processing device.

4. The multi-ringed differential microphone array of claim 1, wherein the first substantial circle and the second substantial circle are concentric circles with respect to a center, and wherein the first radius is smaller than the second radius.

5. The multi-ringed differential microphone array of claim 4, further comprising a central microphone located at the center.

6. The multi-ringed differential microphone array of claim 4, wherein the processing device is further to:

construct the N-th order minimum-norm beamformer by matching an approximation of a beampattern associated with the multi-ringed differential microphone array to a target beampattern.

7. The multi-ringed differential microphone array of claim 6, wherein the approximation of the beampattern associated with the differential microphone array comprises a plurality of exponential components that each corresponds to a respective one of the first number of microphones and the second number of microphones, and wherein each one of the plurality of exponential components is approximated by a corresponding Jacobi-Anger series to the N-th order.

8. A system comprising:

a data store; and a processing device, communicatively coupled to the data store, to:

receive a plurality of electronic signals generated, responsive to a sound source, by a first number of microphones situated along a first substantial circle having a first radius and by a second number of microphones situated along a second substantial circle having a second radius, wherein a multi-ringed differential microphone array comprises the first number of microphones and the second number of microphones located on a substantially planar platform, and wherein the first number is smaller than the second number;

determine a differential order (N) based on the second number; and execute an N-th order minimum-norm beamformer to calculate an estimate of the sound source based on the plurality of electronic signals.

9. The system of claim 8, wherein each one of the plurality of electronic signals represents a respective version of the sound source received at a corresponding one of the plurality of microphones.

10. The system of claim 8, further comprising:

an analog-to-digital converter, communicatively coupled to the first number of microphones, the second number of microphones, and the processing device, to convert the plurality of electronic signals into a plurality of digital signals for the processing device.

11. The system of claim 8, wherein the first substantial circle and the second substantial circle are concentric circles with respect to a center, and wherein the first radius is smaller than the second radius.

12. The system of claim 11, wherein the multi-ringed differential microphone further comprises a central microphone located at the center.

13. The system of claim 11, wherein the processing device is further to:

construct the N-th order minimum-norm beamformer by matching an approximation of a beampattern associated with the multi-ringed differential microphone array to a target beampattern.

14. The system of claim 13, wherein the approximation of the beampattern associated with the differential microphone array comprises a plurality of exponential components that each corresponds to a respective one of the first number of microphones and the second number of microphones, and wherein each one of the plurality of exponential components is approximated by a corresponding Jacobi-Anger series to the N-th order.

15. A method comprising:

receiving, by a processing device, a plurality of electronic signals generated, responsive to a sound source, by a first number of microphones situated along a first substantial circle having a first radius and by a second number of microphones situated along a second substantial circle having a second radius, wherein a multi-ringed differential microphone array comprises the first number of microphones and the second number of microphones located on a substantially planar platform, and wherein the first number is smaller than the second number;

determining a differential order (N) based on the second number; and executing an N-th order minimum-norm beamformer to calculate an estimate of the sound source based on the plurality of electronic signals.

16. The method of claim 15, wherein each one of the plurality of electronic signals represents a respective version of the sound source received at a corresponding one of the plurality of microphones.

17. The method of claim 15, wherein the first substantial circle and the second substantial circle are concentric circles with respect to a center, and wherein the first radius is smaller than the second radius.

18. The method of claim 15, wherein the multi-ringed differential microphone further comprises a central microphone located at the center.

19. The method of claim 14, wherein the processing device is further to:

construct the N-th order minimum-norm beamformer by matching an approximation of a beampattern associated with the multi-ringed differential microphone array to a target beampattern, wherein the approximation of the beampattern associated with the differential microphone array comprises a plurality of exponential components that each corresponds to a respective one of the first number of microphones and the second number of microphones, and wherein each one of the plurality of exponential components is approximated by a corresponding Jacobi-Anger series to the N-th order.

20. A non-transitory machine-readable storage medium storing instructions which, when executed, cause a processing device to:

receive, by the processing device, a plurality of electronic signals generated, responsive to a sound source, by a first number of microphones situated along a first substantial circle having a first radius and by a second number of microphones situated along a second substantial circle having a second radius, wherein a multi-ringed differential microphone array comprises the first number of microphones and the second number of microphones located on a substantially planar platform, and wherein the first number is smaller than the second number;

determine a differential order (N) based on the second number; and execute an N-th order minimum-norm beamformer to calculate an estimate of the sound source based on the plurality of electronic signals.

* * * * *